US005813395A

United States Patent [19]

Taplan et al.

[11] Patent Number: 5,813,395

[45] Date of Patent: Sep. 29, 1998

[54] DEVICE FOR PROTECTING RIMS IN GLASS OR CERAMIC BODIES

[75] Inventors: Martin Taplan, Rheinbollen; Stefan Hubert, Bubenheim; Boris Marx, Oberwiesen; Thomas Heisner, Mainz, all of Germany

[73] Assignee: Schott Glaswerke, Mainz, Germany

[21] Appl. No.: 564,473

[22] Filed: Nov. 29, 1995

[30] Foreign Application Priority Data

Nov. 30, 1994 [DE] Germany ..... 44 42 572.4

[51] Int. Cl.[6] ..... F24C 13/10

[52] U.S. Cl. ..... 126/214 A; 126/214 C; 126/214 D; 126/221; 126/39 R; 126/39 N; 126/39 H

[58] Field of Search ..... 126/214 A, 214 C, 126/221, 214 D, 555, 39 R, 39 N, 39 H

[56] References Cited

U.S. PATENT DOCUMENTS 4,593,677 6/1986 Sargunam ..... 126/39 R X
5,046,477 9/1991 Bennett et al. ..... 126/39 B
5,313,929 5/1994 Thürk et al. ..... 126/39 B

FOREIGN PATENT DOCUMENTS 0 551 235 7/1993 European Pat. Off. .
U1-29502661.8 5/1995 Germany .
2149089 6/1985 United Kingdom .

*Primary Examiner*—Larry Jones
*Attorney, Agent, or Firm*—Millen, White, Zelano, & Branigan, P.C.

[57] ABSTRACT

The invention provides a device for clasp the rims of openings in shaped bodies made of glass ceramic, glass or ceramic, especially openings for the passage of atmospheric gas burners on cooking hobs or stovetops, from mechanical damage and for preventing soiling and damage to arrangements situated underneath the shaped body owing to the ingress of liquids through the openings in the shaped body. The clasp reaches over the rim of the respective opening and extends onto both the top and bottom sides of the shaped body. A sealing and/or heat-insulating material is advantageously inserted between the shaped body and the clasp.

21 Claims, 5 Drawing Sheets

DEVICE FOR PROTECTING RIMS IN GLASS OR CERAMIC BODIES

SUMMARY OF THE INVENTION

The invention relates to a device for protecting the rims of openings in shaped bodies made of glass ceramic, glass or ceramic, especially from mechanical damage, and for preventing soiling and damage to arrangements situated underneath the shaped body owing to the ingress of liquids through the openings in the shaped body. In particular, the invention relates to a device for protecting openings in cooking hobs or stove tops for the passage of atmospheric gas burners.

On known gas stovetops, gas ranges or cooking hobs with burner arrangements of this kind, the gas burners are mounted in a fixed manner in the supporting frame or housing. A glass plate, in particular a prestressed glass plate, covering the area surrounding the gas burners is provided with an opening which is considerably larger than is actually necessary for the respective gas burner. The wide annular gap thereby formed between the gas burner and the rim of the opening is covered with a simple annular collar made of sheet metal. Although this ensures mechanical separation of the gas burner from the glass plate, this way of installing the gas burner in the glass plate has disadvantageous effects in practical use, particularly with respect to cleaning characteristics. It is, for instance, possible with these devices for material that has boiled over to enter the joint between the prestressed glass plate and the sheet-metal collar. Cleaning these devices is difficult and may even require in many cases at least partial disassembly.

Furthermore, such connections have a large number of individual parts and, as a result, are expensive and their assembly is very involved.

DE 41 33 409 C2 (see also U.S. Pat. No. 5,313,929) discloses a burner arrangement, intended, for example, for cooking hobs, in which at least one gas burner is mounted in a supporting frame and the area surrounding the gas burner is covered by means of a shaped body made of glass, glass ceramic or ceramic. Each gas burner projects above the top side of the shaped body through an opening in the latter. A permanently elastic connecting and sealing device with a connecting and sealing element, which engages firmly and in a liquid-tight manner on the rim area of the opening and on at least one connecting surface formed by the gas burner, is fitted between the shaped body and each gas burner. The gas burner is thus supported by the shaped body. Also, securing and holding devices are fitted between the gas burner and the supporting frame. These devices help to retain and secure each gas burner against rotation—while at the same time permit limited movement—if the shaped body breaks and thus loses its load-bearing ability.

The assembly of this burner arrangement is a complex operation. Moreover, although adhesive bonding solves the problem of providing mechanically rigid joints, it is a disadvantage when it comes to recycling, assembly (due, for example, to the drying time required by the silicone adhesive) and servicing.

U.S. Pat. No. 5,046,477 discloses the possibility of improving the sealing of a burner relative to a glass or glass-ceramic shaped body. In this case, the opening in the shaped body is made only as large as it needs to be to accept the gas burner. For the purpose of sealing, the gas burner is firmly connected to the glass or glass-ceramic shaped body at the rim of the opening. The gas burner is furthermore attached to a bracket connected to the supporting frame.

When the cooking surfaces are subjected to mechanical or thermal loading, however, a mechanically rigid connection of this kind between a brittle shaped body, a supporting frame and the gas burners gives rise to stresses in the shaped body. In the case of a cooking hob, gas stovetop or gas range, the risk that the shaped body will break is considerably increased in all such cases.

Therefore, an object of the invention, in regard to a burner arrangement of the type described above, is to provide a sealing and/or heat-insulating protection device between a gas burner and the shaped body made of glass ceramic, glass or ceramic, which device is fully effective for practical use and is also easy to clean.

A further object is to provide such a protective device which ameliorates or eliminates the risk of breakage due to stresses.

At the same time, another object is to provide such a protective device the assembly of which can be performed in a simple manner, without adhesive bonding work and with little expenditure of time, material and money.

A further object underlying the invention is to pass atmospheric gas burners through the shaped body and position them safely and in a suitable manner and to provide edge protection for the rim of the hole.

Upon further study of the specification and appended claims, further objects and advantages of this invention will become apparent to those skilled in the art.

To achieve these objects, the invention proposes using a clasp which reaches over the rim of the respective opening and onto the shaped body onto both the top and bottom sides thereof. In a particularly preferred embodiment, a sealing and/or heat-resistant material is inserted between the shaped body and the clasp.

According to the invention, the clasp has a body, which has a smaller diameter than the opening in the shaped body, and a collar which is connected to one end of the clasp body. The collar bends through at an angle of at least 90° away from the axis of the body and its outer edge ends, preferably, level with the shaped body, i.e., the outer edge of the collar preferably rests on the top surface of the shaped body. At the other end of the clasp body there are provided at least three, especially eight or more, bendable tabs which can be bent away from the axis of the body in the direction of the plane of the shaped body. The clasp thereby formed is fixed in a stable manner onto the shaped body. The clasp is clamped to the shaped body, on the one hand, by means of its tabs—which can be bent through at least 90° away from the axis of the body—which reach over one side of the shaped body and, on the other hand, by means of the collar, which rests on the other side of the shaped body.

The clasp body is preferably cylindrical in shape although it is also possible to use other circular shapes, e.g., frustoconical, for protecting circular openings in the, for example, glass-ceramic stove top. If the openings in the shaped body are noncircular, the shape of the clasp body can be appropriately modified to conform thereto. The collar can rest level on the top surface of the shaped body or, for example, the collar can be sloped downward so that its outer edge rests on the top surface of the shaped body.

In a preferred embodiment, in addition to the bending tabs which extend out over the rim area of the opening in the shaped body on one side thereof, the clasp has further tabs, which project into the area of the opening and thus can serve as means for supporting a surface formed by the gas burner. Alternatively, a portion of the collar, as well as tabs, can project into the area of the opening and form two, e.g., parallel, planes between which a surface formed by the gas burner can be held. This embodiment considerably simplifies the positioning and centering of the gas burner.

The clasp can be of one-piece design and the tabs can be designed as bending tabs. However, it is also sometimes advantageous for the clasp to be of multi-part design wherein the parts which form the clasp can be connected together by press fitting, soldering, adhesive bonding, screw-fastening or by means of a bayonet joint. In this multi-piece variant, the tabs are also preferably designed as bending tabs.

Since the openings in the shaped bodies made of glass ceramic, glass or ceramic are generally round, the clasp is consequently preferably designed as a clasp ring with a cylindrical body. In a further preferred embodiment, the clasp ring is designed as an open prestressed spring element which presses itself against the rim of the opening in the shaped body.

The clasp can be made from a variety of suitable materials including, for example, aluminum and deep drawn, cold rolled (stainless) steel.

In a further advantageous variant of the invention, the clasp has a collar at one end of the cylindrical body, and a simple clamping element, in particular a metallic clamping ring, which surrounds the body is positioned at the other end of the cylindrical clasp body. The clamping element is fixed in a defined manner on the clasp body, in particular by notches and/or by bends in the clasp body.

All embodiments of the protective device according to the invention have in common that a sealing and/or heat-insulating material, especially a temperature-stable, graphite-containing material and/or a ceramic composite fiber material is expediently inserted between the shaped body and the clasp.

On the top side, the seal performs the task of forming a liquid-tight barrier between the clasp and the glass ceramic, glass or ceramic against, for example, material that has boiled over and/or cleaning agents. On the underside, the seal protects the shaped body from mechanical scratching and damage by the metal.

It may be advantageous for the collar of the clasp to have openings for the air supply to the gas burner, in particular in the area surrounding the body. The openings for the air supply are positioned or covered in such a way as to repel moisture.

In a particularly preferred embodiment of the protective device, the rims of the collar or tabs, in particular, the rim of the collar of the clasp, are bent toward the shaped body in such a way that the sealing and/or heat-insulating material is held under compressive stress.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1A:
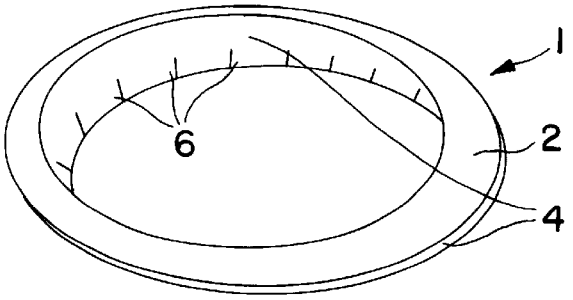
FIG. 1*a* shows a perspective view of a one-piece clasp ring with bending tabs.
Figure 1B:
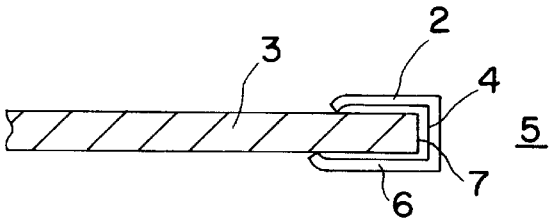
FIG. 1*b* shows a partial section of a one-piece clasp according to the invention.

FIGS. 1*a* and 1*b* show a one-piece clasp ring (1) with a collar (2) which runs around the opening (5) and overlaps onto to the top surface of the glass-ceramic plate (3). The clasp ring (1) also overlaps the rim (7) of opening (5) with a body (4) which has a smaller diameter than opening (5). Formed on the end of the body (4) are tabs (6) (at least 3 and preferably 8), which are simply bent outward from the interior of opening (5) through 90° and over the glass-ceramic plate (3), thus clamping the ring (1) firmly on the rim (7) of the opening (5) in the glass-ceramic plate (3).

Figure 2A:
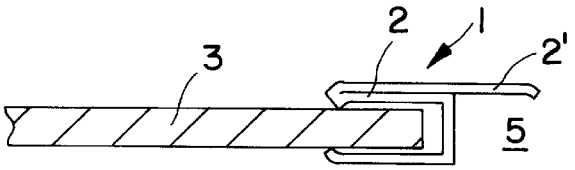
FIGS. 2*a* and 2*b* show partial sections of further one-piece embodiments of the invention, in which tabs project into the area of the opening.
Figure 2B:
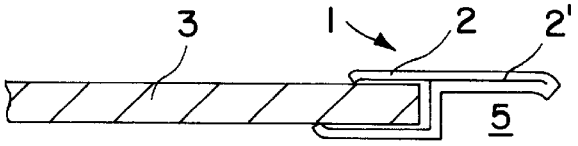

Variants of a one-piece clasp ring (1) are shown in FIGS. 2*a* and 2*b*. In these variants, the overlapping collar (2)/(2') runs around the opening (5) and overlaps the top side of glass-ceramic plate (3). Simultaneously, the collar (2)/(2') passes inward over the rim of opening (5) at the top side of the glass-ceramic plate (3) and there serves as a support for the burner (not shown).

Figure 2C:
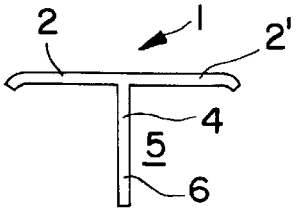
FIG. 2*c* shows a partial section of a preform of a simple one-piece clasp.

FIG. 2*c* shows a preform of particularly simple configuration for a clasp having a collar (2) which overlaps onto the top side of the glass-ceramic plate (3), a body (4) with bending tabs (6) and also, in addition, a further part of the collar (2') which extends into the area of the opening (5) in the shaped body (3).

Figure 3:
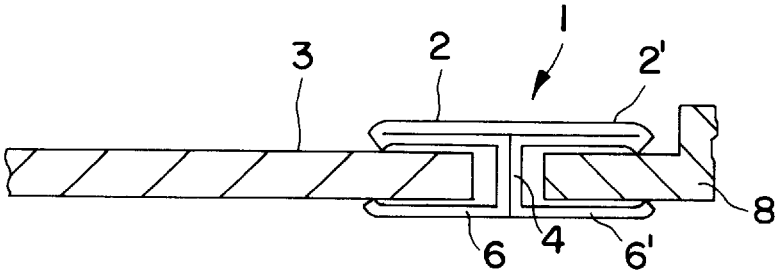
FIG. 3 shows a partial section of a one-piece embodiment in which an inward-projecting collar portion and inward-projecting tabs form two parallel planes for the purpose of fastening the gas burner.

FIG. 3 shows a one-piece clasp ring (1) in which the overlapping collar (2)/(2') simultaneously passes into the area of the hole (5) at the top side of the shaped body (3) and there serves as a support for the burner (8). The tabs (6)/(6') at the other end of the body (4) are bent alternately outward over the bottom of the glass ceramic plate (3) and in the other direction over part of the burner (8).

Figure 4:
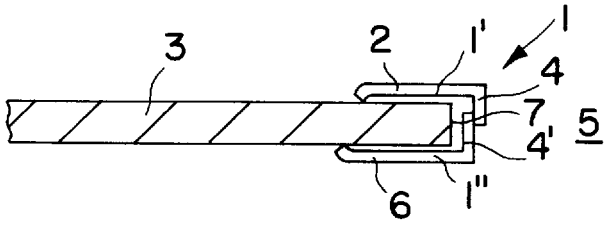
FIG. 4 shows a partial section of a two-piece clasp.

FIG. 4 illustrates a two-piece clasp ring (1). Two rings, one for the top side (1') and one for the under side (1"), with encircling overlaps, i.e., collar (2) and tabs (6) and matching body diameters (4)/(4') are inserted one into the other from above and below and in this way protect the rim (7) of the hold. The matching of the body diameters must be such that the pair of rings (1')/(1") cannot come apart by itself. This can be achieved, for example, by a press fit between the two parts. In such a case, the edge of top ring (1') can overlap that of bottom ring (1") (as shown) or vice versa. Another possibility is to join the two rings (1')/(1") together by, for example, soldering or adhesive bonding.

Figure 5A:
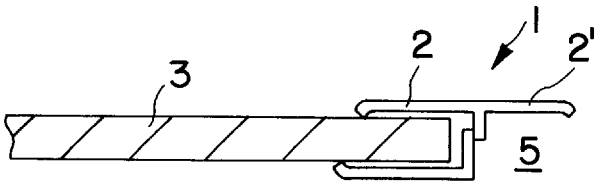
FIGS. 5*a*, 5*b* and 5*c* show partial sections of further two-piece embodiments, in which tabs project into the area of the opening in the shaped body.
Figure 5B:
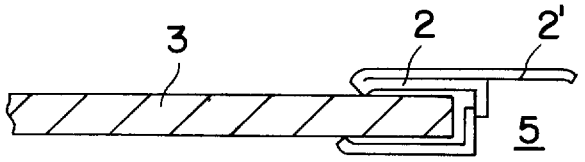
Figure 5C:
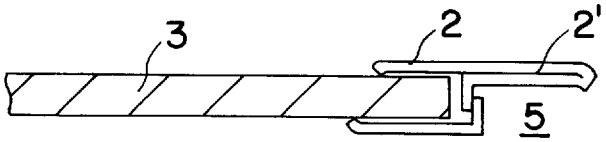

FIGS. 5*a,* 5*b* and 5*c* show three possible variants of a two-piece embodiment of the protective device according to the invention. In these variants, the overlapping collar (2)/(2') simultaneously passes into the area of the opening (5) at the top side of the shaped body (3) and there serves as support for the burner (not shown).

Figure 5D:
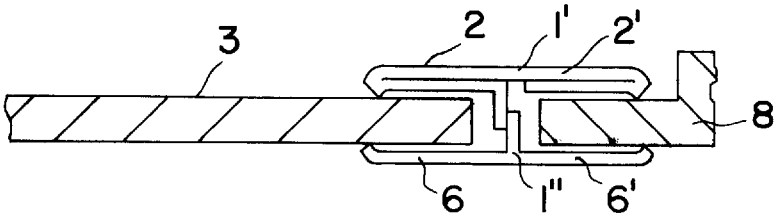
FIG. 5*d* shows a partial section of a two-piece embodiment in which an inward-projecting collar portion and inward-projecting tabs form two parallel planes for the purpose of fastening the gas burner.

FIG. 5*d* illustrates a partial section of a two-piece embodiment in which the overlapping collar, as well as tabs, project inward into the area of the opening to form two parallel planes (2') and (6') for the purpose of fastening and positioning the gas burner (8). If desired, the rings (1')/(1") can be joined together by soldering, adhesive bonding or by clips.

Figure 6A:
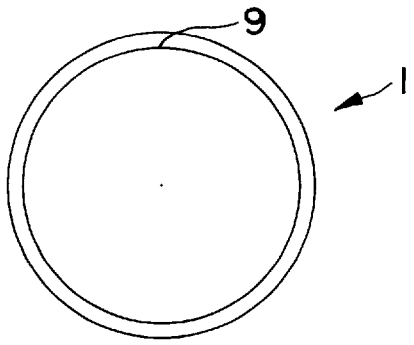
FIGS. 6*a* and 6*b* show a plan view and a partial section, respectively, of a split clasp ring designed as a spring element.
Figure 6B:
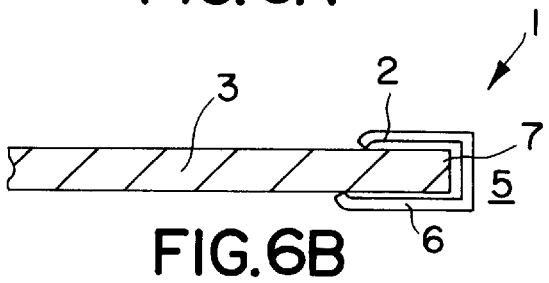

FIGS. 6*a* and 6*b* illustrate a variant of the invention in which a clasp ring (1), split in the direction of the cylinder axis, is inserted as a spring element into the opening (5) in the shaped body (3).

In the opening (5), the spring prestress presses the ring (1) against the rim (7) of the opening, thus providing a protective device which extends over the rim (7) of the opening (5) at its top by plane (2) and at its bottom by plane (6).

Figure 6C:
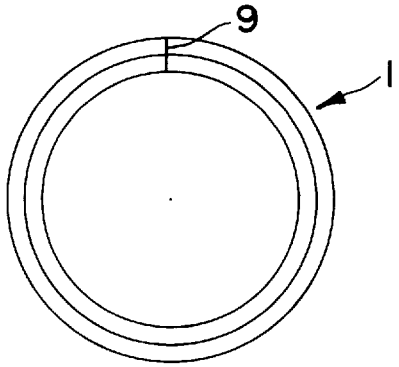
FIGS. 6*c*, 6*d* and 6*e* show a plan view and partial sections of two embodiments of split clasp rings in which tabs also project into the area of the opening.
Figure 6D:
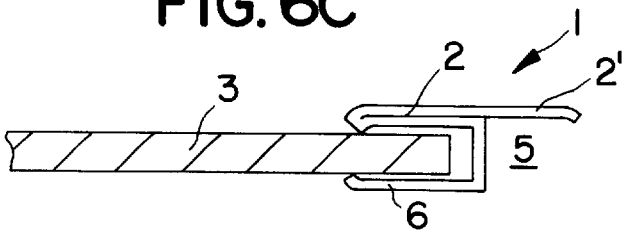
Figure 6E:
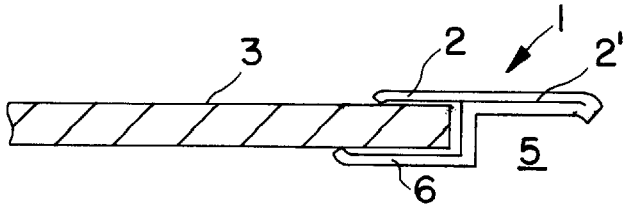

According to FIGS. 6*c,* 6*d* and 6*e,* it is also possible in the case of a clasp ring (1) split in accordance with FIGS. 6*a*/6*b,* for overlapping collar (2) to extend inward into the area of the opening (5) in the shaped body (3).

Figure 7:
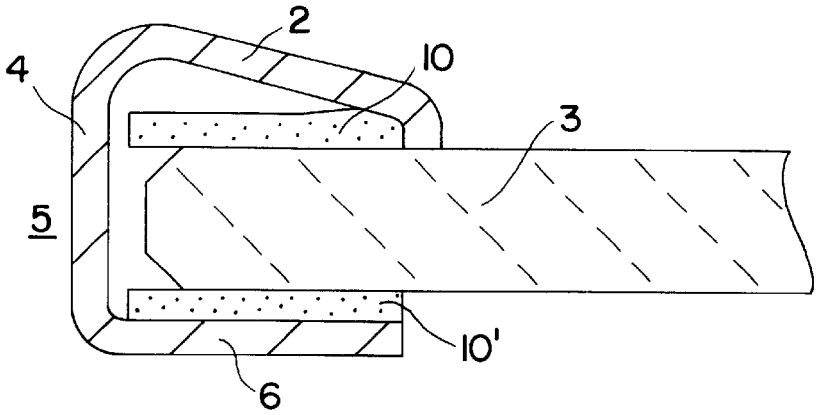
FIG. 7 shows a partial section of the protective device according to the invention with sealing materials.

In all the embodiments of the protective device according to the invention which have been considered, it is desirable, as shown in FIG. 7, to have seals (10)/(10') fitted between the shaped body (3), e.g., a glass ceramic plate, and overlapping collar (2) and/or tabs (6) of the clasp (1). Thus, seals can be provided on the top surface of the shaped body (3) and, where possible, also on the bottom surface.

On the top surface, the seal (10) performs the task, in particular, of forming a liquid-tight barrier against the ingress of material that has boiled over and/or cleaning agents, for example, between the clasp (1) and the glass ceramic, glass or ceramic shaped body. On the underside, the seal (10') protects the shaped body (3) from mechanical scratching and damage by the metal tabs (6).

FIG. 7 furthermore shows a special variant of the clasp (1). In this variant, the outer edge of overlapping collar (2) is bent toward the surface of the shaped body (3) and, by virtue of its design, holds the seal (10) under pressure.

Figure 8:
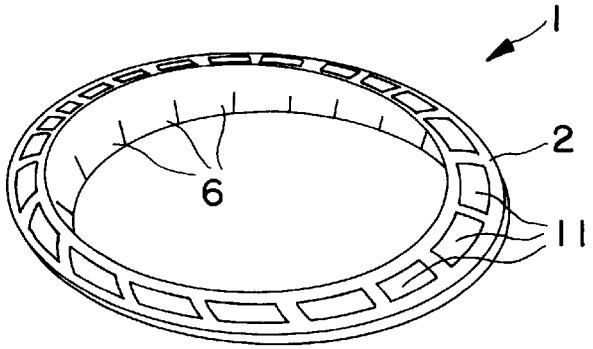
FIG. 8 shows a perspective view of a clasp ring with air slots distributed uniformly over the circumference.
Figure 9:
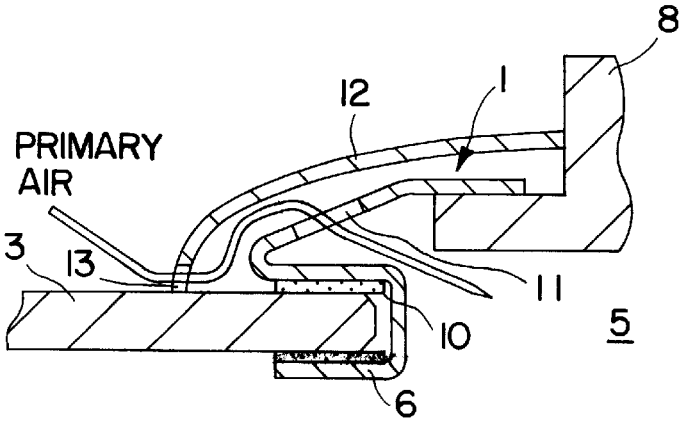
FIG. 9 shows a partial section of a clasp ring provided with air slots and a decorative ring which covers the clasp ring.

In the variant shown in FIGS. 8 and 9, air inlets (11), through which the gas burner (8) can draw in its primary air, are provided in a uniformly distributing manner on the circumference of the collar (2). This clasp ring (1) is fixed in the drill hole or opening (5) in the same way as the other rings were, namely by bending over the tabs (6).

At the same time, the other end of collar (2) can serve as a support for the gas burner (8). To ensure that no material that has boiled over or water used for rinsing can get through the air slots into the interior of the hob during cleaning or during cooking, the clasp ring (1) is covered with a decorative ring (12), which is simply placed over ring (1). The decorative ring (12) merely rests loosely upon the shaped body (3) and is fixed on the burner housing. To allow the primary air required to enter nevertheless, small feet are formed all the way round the bottom edge of decorative ring (12), leaving defined gaps (13) between the decorative ring (12) and the glass ceramic (3).

Figure 10:
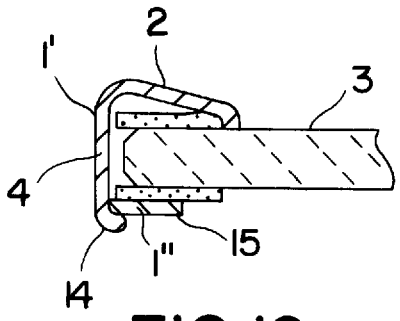
FIG. 10 shows a partial section of a further variant of the clasp ring with a clamping element.
Figure 11:
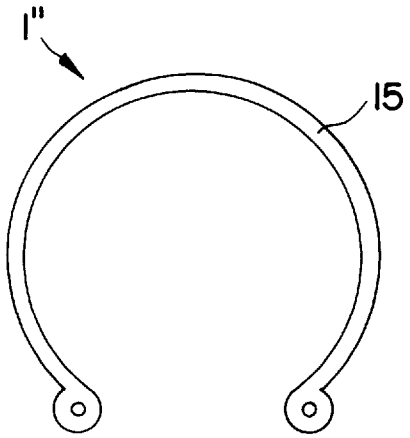
FIG. 11 shows a perspective view of a clamping ring in accordance with FIG. 10.

FIGS. 10 and 11 illustrate yet another embodiment of the invention, in which the clasp ring (1') is inserted as a spring element. The ring (1') has a collar (2) at one end of the body (4) and a simple metallic clamping element (15), forming a second ring (1"), is positioned at the other end of the body (4) and surrounds the body (4). The clamping element (15) is here fixed in a defined way, e.g., by a nose-shaped bent portion or ledge (14) of the ring (1'). The clamping element (15) slips over the clasp body (4) so that it is inserted between the shaped body (3) and the peripheral ledge (14). The ends of clamping element (15) have ring-shaped openings to facilitate assembly using tongs adapted therefor.

The present invention discloses a simple and inexpensive means of allowing gas burners to be passed through a glass or glass-ceramic plate and of protecting the rims of the openings during assembly and against ingress of liquids during use. These means have advantages during assembly and in the case of servicing, allow the maximum possible freedom of design. At the same time, these means are elegant, easy to clean and economical to manufacture.

Advantages of the invention include the following:

- there is no mechanically rigid connection between the glass ceramic, glass or ceramic body and the gas burner. This is necessary to allow the energy which arises during mechanical loading of the shaped body to be absorbed without the shaped body being broken,
- in the event of breakage, something which can never be ruled out with glass/glass ceramic/ceramic bodies, there is the assurance that the gas supply conduit to the gas burner will remain intact and leak-tight,
- the rim of the burner opening is protected from impermissibly high mechanical loads,
- there is the assurance that no material that has boiled over or other liquids can run into the interior of the stove or cooker,
- there is little assembly work involved, and this means also that
- the servicing work involved in the replacement of defective components or the replacement of jets, e.g., for different types of gas, is easy and inexpensive.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

The entire disclosure of all applications, patents and publications, cited above, and of corresponding German application P 44 42 572, filed Nov. 30, 1994, are hereby incorporated by reference.

The preceding can be repeated with similar success by substituting the generically or specifically described reactants and/or operating conditions of this invention for those used herein.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A clasp for protecting a rim of an opening in a substrate made of glass, ceramic or glass ceramic, said clasp comprising:

a circular body, a collar attached to the top of said circular body and extending outward from the axis of said circular body, and, attached to the bottom of said circular body, at least three tabs bendable in a direction away from said axis of said circular body.

2. A clasp according to claim 1, wherein the angle between said collar and said axis is at least 90°.

3. A clasp according to claim 1, further comprising at least three tabs, attached to the bottom of said circular body, which are bendable in the direction toward said axis.

4. A clasp according to claim 1, wherein said circular body is cylindrical.

5. A clasp according to claim 1, wherein said clasp is an integral one-piece element.

6. A clasp according to claim 1, wherein said clasp is made of multiple pieces.

7. An arrangement comprising:

a substrate made of glass ceramic, glass or ceramic, said substrate having at least one opening; and at least one clasp for protecting the rim of said at least one opening from mechanical damage and for inhibiting ingress of liquids through said at least one opening;

said clasp being positioned within said at least one opening, said clasp comprising a collar portion which extends over the rim of said at least one opening and onto the top surface of said substrate, and at least three tab portions which extend over the rim of said at least one opening and onto the bottom surface of said substrate.

8. An arrangement according to claim 7, wherein said clasp has a circular body, the diameter of which is smaller than the diameter of said at least one opening in said substrate, said collar portion is connected to said circular body at one end thereof and is positioned at an angle of at least 90° from the axis of said circular body, and said at least three tabs are attached to the other end of said circular body and are bent in the direction of said substrate away from said axis, whereby said clasp is stably fixed in said opening of said substrate.

9. An arrangement according to claim 8, wherein said clasp further comprises additional bending tabs which project toward the axis of said circular body.

10. An arrangement according to claim 7, wherein said clasp is made of multiple elements and said elements are connected by a connection selected from the group consisting of a press fitting, solder, adhesive bond, fastened screw and a bayonet joint.

11. An arrangement according to claim 10, wherein said tab portions are bendable tabs.

12. An arrangement according to claim 7, wherein said clasp has a cylindrical body.

13. A device according to claim 12, wherein said clasp is a prestressed spring element which presses against the rim of said opening.

14. An arrangement according to claim 12, wherein said collar portion is attached to one end of said cylindrical body and, at the other end of said cylindrical body, a clamping element surrounds said cylindrical body.

15. An arrangement comprising:

a substrate made of glass ceramic, glass or ceramic, said substrate having at least one opening; and at least one clasp for protecting the rim of said at least one opening from mechanical damage and for inhibiting ingress of liquids through said at least one opening;

said clasp being positioned within said at least one opening, said clasp comprising a collar portion which extends over the rim of said at least one opening and onto the top surface of said substrate, and at least three tab portions which extend over the rim of said at least one opening and onto the bottom surface of said substrate; and further comprising at least one element made of a sealing and heat-resistant material inserted between said substrate and said clasp.

16. An arrangement according to claim 15, wherein said sealing and heat-resistant material inserted between said substrate and said clasp is selected from the group consisting of a graphite-containing material, a ceramic composite fiber material, and a combination thereof.

17. An arrangement according to claim 15, wherein an element selected from the group consisting of the rims of said tab portions, the rim of said collar and both the rims of said tab portions and rim of said collar is bent toward said substrate whereby said sealing and heat-resistant material is held under compressive stress.

18. An arrangement comprising:

a substrate made of glass ceramic, glass or ceramic, said substrate having at least one opening; and at least one clasp for protecting the rim of said at least one opening from mechanical damage and for inhibiting ingress of liquids through said at least one opening;

said clasp being positioned within said at least one opening, said clasp comprising a circular body, the diameter of which is smaller than the diameter of said at least one opening in said substrate, a collar portion connected to said circular body which extends over the rim of said at least one opening and onto the top surface of said substrate and also extends toward the axis of said circular body, at least three bending tabs attached to the other end of the circular body which are bent in the direction of said substrate away from said axis and additional bending tabs which project toward the axis of said circular body, whereby said collar portion and said additional bending tabs form two parallel planes between which a surface of a gas burner is held.

19. An arrangement comprising:

a substrate made of glass ceramic, glass or ceramic, said substrate having at least one opening; and at least one clasp for protecting the rim of said at least one opening from mechanical damage and for inhibiting ingress of liquids through said at least one opening;

said clasp being positioned within said at least one opening, said clasp comprising a collar portion which extends over the rim of said at least one opening and onto the top surface of said substrate, at least three tab portions which extend over the rim of said at least one opening and onto the bottom surface of said substrate, and openings for passage of air.

20. A device according to claim 19, wherein said openings for passage of air are positioned to avoid moisture.

21. A method for protecting the rim of an opening through a glass, ceramic or glass ceramic substrate, said method comprising:

inserting a clasp according to claim 1 into said opening, and bending said at least three tabs outward from the axis of said circular body whereby said clasp is attached to said substrate.

* * * * *